US005439600A

United States Patent [19]

Pasoz

[11] Patent Number: 5,439,600

[45] Date of Patent: Aug. 8, 1995

[54] APPARATUS AND METHOD FOR REMOVAL OF FLOATING DEBRIS

[76] Inventor: Louis W. Pasoz, 2947 Calle Frontera, San Clemente, Calif. 92672

[21] Appl. No.: 832,795

[22] Filed: Feb. 7, 1992

[51] Int. Cl.[6] ..... C02F 1/40

[52] U.S. Cl. ..... 210/776; 210/767; 210/169; 210/242.1; 210/242.3

[58] Field of Search ..... 210/800, 169, 242.1, 210/776, 258, 159, 195.3, 923, 242.3, 767, 242.4; 4/507, 512

[56] References Cited

U.S. PATENT DOCUMENTS

| | | | |
|---|---|---|---|
| 3,067,879 | 12/1962 | Baker | 210/169 |
| 3,555,574 | 8/1969 | Stanwood | 210/169 |
| 3,628,664 | 12/1971 | Standwood | 210/169 |
| 3,695,441 | 10/1972 | Chastan-Bagnis | 210/242.1 |
| 3,860,518 | 6/1975 | Henricksen | 210/776 |
| 3,910,840 | 10/1975 | Adam | 210/169 |
| 4,024,063 | 5/1977 | Mori | 210/242 |
| 4,348,281 | 9/1982 | Perry et al. | 210/169 |
| 4,405,458 | 9/1983 | McHugh, Jr. | 210/242.3 |
| 4,426,286 | 1/1984 | Puckett et al. | 210/169 |
| 4,601,833 | 7/1986 | Shubert | 210/744 |
| 4,743,368 | 5/1988 | Gates | 210/169 |
| 4,802,592 | 2/1989 | Wessels | 210/169 |
| 4,826,591 | 5/1989 | Macia | 210/169 |
| 5,217,611 | 6/1993 | Ayroldi | 210/242.1 |

*Primary Examiner*—Robert A. Dawson
*Assistant Examiner*—Ana M. Fortuna
*Attorney, Agent, or Firm*—Brown, Martin, Haller & McClain

[57] ABSTRACT

The apparatus for removal of debris from water comprises a body with at least one inlet to allow liquid to flow into the body, a water pump for pulling liquid into and through the body to an outlet, and a grating to catch and collect the debris. Brackets at the side or top of the body permit attachment to a dock or floating platform. The inlet has at least one weir with a shape to create a flow differential at the inlet of the body. The water pump pumps at such a speed to maintain the highest point on the bottom edge of the inlet at a level below the water line outside the body, and to maintain the water level within the body slightly below that of the water outside the body.

20 Claims, 1 Drawing Sheet

FIG. 1
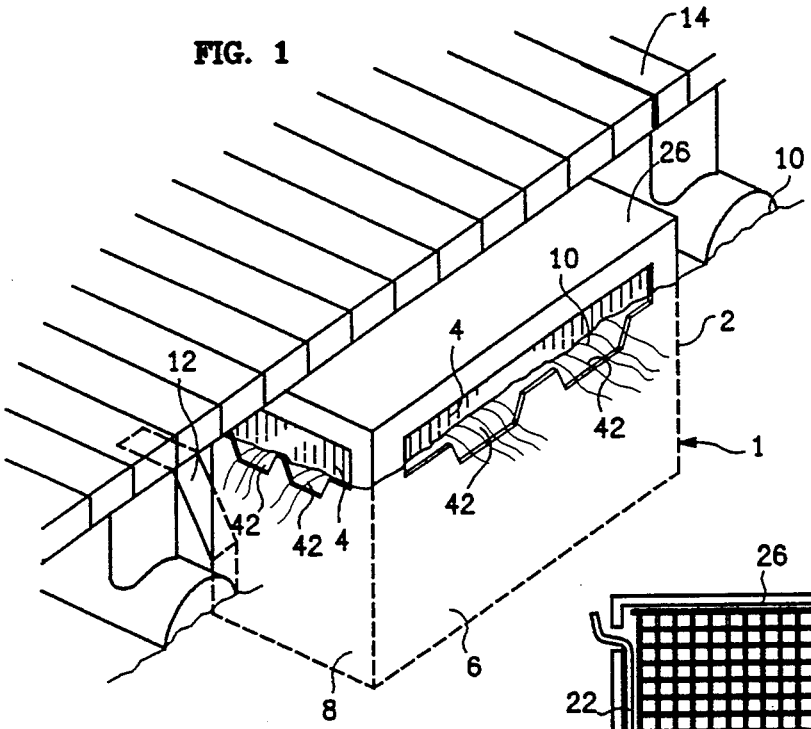
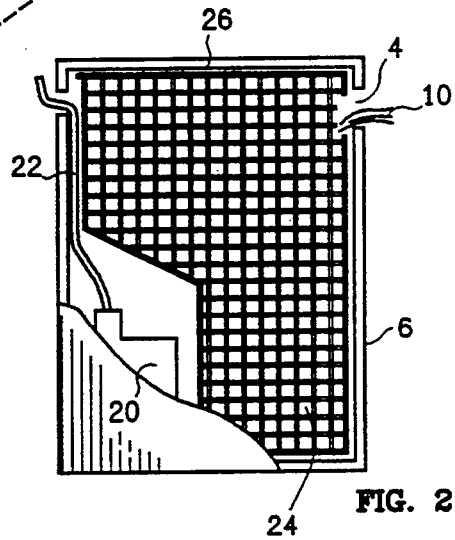
FIG. 2
FIG. 4
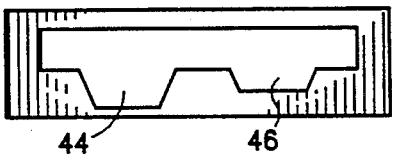
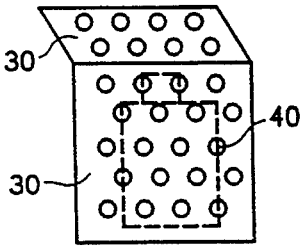
FIG. 3
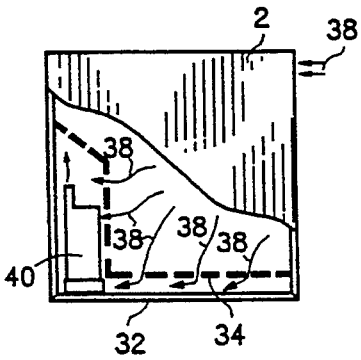
FIG. 5
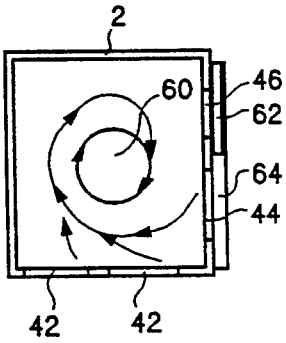
FIG. 6

APPARATUS AND METHOD FOR REMOVAL OF FLOATING DEBRIS

BACKGROUND OF THE INVENTION

Bodies of water near populated areas are more often than not subject to pollution from both chemical and solid waste. Many inventions have been addressed to the removal of oil slicks or other chemical films which float on the water surface. Among these are the floating weirs of McHugh, Jr. (U.S. Pat. No. 4,405,458 issued Sep. 20, 1983) and Wessels (U.S. Pat. No. 4,802,592 issued Feb. 7, 1989). Both of these systems are remote from the pumping unit, being connected by a suction hose, and are similar to well-known pool cleaners. Another system is that of Shubert (U.S. Pat. No. 4,618,833 issued Jul. 22, 1986) which is a floating trough for removal of effluent fluid at a predetermined level beneath the surface of the water. While advances have been addressed to liquid separation, solid waste is still primarily dealt with by manually collecting the debris with nets.

Agglomerations of solid waste in bodies of water are most obvious in marinas and harbors. Since these areas are heavily used, individuals and businesses who use these areas are often guilty of carelessly discarding used containers, paper, plastic bags and other garbage, which end up in the water. Added to this pollution are plant debris and dead birds or sea life. In harbors and marinas, localized currents can cause the floating debris to collect in small areas, resulting in unsightly and unsanitary masses of garbage many yards in diameter. Exacerbating these conditions are water intakes for utilities or industrial facilities which create currents drawing the floating debris toward a collection area. The debris can then clog the grates over the intakes, resulting in damage to the intake system and the equipment that the water is used to drive or cool.

Pool skimmers and other floating-matter removing apparatus are designed primarily to separate floating liquid pollutants from water. While they may be able to collect small floating debris (bugs, leaves) they are too small and lightweight to handle the large type of debris typically found in marinas and harbors, and too complex to simply scale up to accommodate such large debris.

Further, a pool skimmer-type system would, if scaled up, have such a large, powerful pump that it could be a hazard to marine life, possibly drawing in birds and fish that swim too close to the device. To protect against this by including filters would then eliminate the device's ability to collect large floating debris. Also of concern is the fact that the weight of a device for removing large debris could be enough to capsize a boat or tear off a section of the dock to which it is attached. Thus, care must be taken in installation of stationary units.

The obstacles involved in creating a system for removal of floating debris from large bodies of water are numerous. It would be desirable to provide a device which overcomes these obstacles and is capable of removing large amounts of the most prevalent form of debris, e.g., metal, glass bottles, paper and plastic containers and bags, found in these bodies of water. The present invention is such a device.

SUMMARY OF THE INVENTION

It is an advantage of the present invention to provide an apparatus which is capable of efficiently and rapidly removing from water, and storing, the most common large and small floating debris.

It is another advantage of the present invention to provide an apparatus which can attach to an existing dock or floating platform without risk of damage to the dock or platform.

Still another advantage of the present invention is that it does not endanger marine life by drawing the animals into the device.

In an exemplary embodiment, the apparatus for removal of debris from water comprises a body with at least one inlet to allow liquid to flow into the body, a water pump for pulling liquid into and through the body to an outlet, and a grating to catch and collect the debris. Brackets at the side or top of the body permit attachment to a dock or floating platform. The inlet has at least one weir with a shape to create a flow differential at the inlet of the body. The water pump pumps at such a speed to maintain the highest point on the bottom edge of the inlet at a level below the water line outside the body, and to maintain the water level within the body slightly below that of the water outside the body.

The body is a generally rectangular box and may be varied in size as needed, depending upon the area of the body of water and the amount of pollution. The top of the box is openable for removing the collected debris. In one embodiment, a mesh basket is closely fitted within the interior walls of the box. For emptying, the basket is lifted out by a crane or other lifting equipment. In locations where lifting equipment is not to be used, a second embodiment has no basket, but rather has perforated partitions to protect the pump from drawing in any of the debris. The collected garbage is manually unloaded by lifting the top and using a shovel, pitchfork or other tool to empty the garbage into another receptacle.

The apparatus is made of material which is sufficiently buoyant so that, in combination with the pump rate, it has substantially neutral buoyancy. This is an important aspect of the invention because, if the apparatus does not float, it can destroy the dock to which it is attached, as it can weigh on the order of 900 lbs. when full. If the apparatus floats too much, the inlet will be above the water level and no flow or debris removal will occur.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which:

FIG. 1 is a perspective view of an apparatus according to the present invention mounted on a dock;

FIG. 2 is a side view, partially cut away, of the apparatus of FIG. 1;

FIG. 3 is a diagrammatic front view of the pump partition according to a first alternate embodiment;

FIG. 4 is a diagrammatic view of an inlet according to a second alternate embodiment;

FIG. 5 is a side view, partially cut away, of the first alternate embodiment; and FIG. 6 is a diagrammatic top view of an open box with a vortex generated therein.

DETAILED DESCRIPTION OF THE PREFERRED EMBODIMENTS

As illustrated in FIGS. 1 and 2, the trash removal apparatus 1 comprises a rectangular box 2 with at least one inlet 4 in its sides 6 and 8 to permit water 10 to flow into its interior. The apparatus 1 is attached by brackets 12 or other attachment means to a dock 14 or floating platform so that the apparatus 1 is raised and lowered in response to tidal changes along with the dock 14. A pump 20 draws water through inlet 4 so that any debris floating in the water 10 is carried into the apparatus 1. Pump 20 exhausts the water through exhaust 22 with the debris becoming trapped inside apparatus 1. Since the water level inside apparatus 1 is lower than the water level outside, the debris cannot float back out of the inlet 4.

In a first embodiment, a basket 24 is constructed to closely fit the inner dimensions of the box 2. The basket 24 is a mesh, grate or perforated sheet with openings on all sides to permit water to flow through the openings while trapping the debris against the basket 24. It is common to find plastic bags among floating debris. When drawn upon with sufficient suction, a plastic bag can cover a large area, so risk of clogs is possible. The basket 24 has sufficient openings to permit water to be drawn through any side to provide alternate flow-through locations in the event that part of the basket becomes clogged with debris. The inlets 4 can also be modified to virtually eliminate the chance of clogging with plastic bags.

The basket 24 is preferably made of perforated acrylic or plastic, but may also be constructed from metal mesh or perforated sheet metal which may be coated with a protective material such as vinyl or polyester, or may be bare metal.

To unload, the top 26 is opened. Top 26 may lift completely off, or it may be hinged. For a greatly scaled-down version it may be possible to manually lift out the basket, but in most situations, the full basket will be too heavy for lifting, even by two persons, since it can weigh on the order of 900 lbs. A crane or other lifting device is placed on the dock next to the apparatus 1 and the basket 24 is lifted out. Cables may be attached to the sides of the basket 24 to facilitate lifting, or the basket 24 can be lifted by its edges. The crane or lifting device may be configured so that it lifts the basket then tilts it to empty into a receptacle attached to the crane, similar to procedures commonly used by garbage collection trucks.

The frequency of the required emptying of the apparatus 1 will depend on the level of pollution in the area to be cleaned. After an initial cleanup, with the apparatus in place, the debris will be removed generally at the same rate at which it is dropped into the water, with a constant level of cleanliness being maintained.

In an alternate embodiment, the basket is omitted and partitions 30 are provided to prevent damage to the pump 40 from drawing in debris, as shown in FIGS. 3 and 5. The partitions 30 are preferably made from the same material as the box 2 and are perforated to permit unobstructed water flow. In this configuration it may also be desirable to place a raised platform 34 at the bottom 32 of the box 2, as shown in FIG. 5, with the platform 34 being perforated and open to the pump to provide additional flow-through surface. The arrows 38 illustrate exemplary water flow.

The material of which the box 2 is constructed is preferably polypropylene, polyethylene, polyvinylchloride (PVC) or similar material which has neutral buoyancy so the apparatus 1 will float. Other materials, including metals and wood, may be adapted to have the desired buoyancy.

Each inlet 4 has one or more weir notches 42 therein to create a flow differential across the inlet surface. The apparatus illustrated in FIG. 1 has two inlets, one on side 6 and one on side 8, each with two weir notches 42. Each inlet 4 will permit positive flow into the box 2 which can carry floating debris into the box 2. The size of the debris collected is limited by the size of the inlets and the weir notches 42. In a test apparatus, inlet 4 was 24" long and about 6" at its narrowest width. The weir notches 42 were 3" deep and 6" wide at their lowest point for the inlet on side 6. The inlet and weir notch width on side 8 were somewhat reduced according to the relative dimension of side 8. Such dimensions should be sufficient to handle most of the floating garbage found in marinas and harbors. The size of the inlet 4 can be varied as needed. The weir configuration of the inlets avoids the possible impairment of function of the apparatus which might be caused by very large objects, such as boards or large branches. Removal of paper, cans and similar floating refuse is unrestricted. Since the latter items make up the bulk of floating debris, these are the primary targets of the apparatus.

As shown in FIG. 4, the weir notches 44 and 46 need not be the same size. By using two different size notches for a single inlet, an additional small current is generated in front of the inlet, with water flowing faster through notch 44. This will also create a slight vortex within the box 2. The risk of clogging of the collection basket with plastic bags can be substantially eliminated by partially closing one of the inlets with one or more sliding doors 62 sliding in tracks 64, as shown in FIG. 6. The flow differential creates a relatively strong vortex 60 in the center of the box 2. Floating plastic bags then become trapped within vortex 60 and cannot settle into the bottom of the box.

An ideal location for installation of the apparatus is one in which debris is known to collect due to existing currents and flow patterns. For example, industrial intakes tend to draw garbage toward themselves. Water outlets and drain pipes will create their own consistent flow patterns which cause floating debris to drift in a particular repeatable direction.

The flow into the apparatus resulting from the pump and inlet configuration has a low flow rate which is sufficient to collect the garbage but small enough that water fowl can swim immediately in front of the inlet without being drawn in. If an animal does inadvertently swim into the apparatus, the flow is not so great that it prevents escape. The recommended flow rate for the apparatus is in the approximate range of 14,000 to 25,000 gallons/minute, depending on the size of the box.

In a test apparatus which rapidly removed floating debris from a badly-polluted marina, the box was approximately 4 feet long, 3 feet wide and 5 feet high. A two-horsepower watertight pump was used with a pumping rate of 14,000 gallons per minute. The box, made of polypropylene, requires reinforcement to strengthen the outer structure against the external pressure of the water, since the water level is higher outside than it is inside. The dimensions of the box can be adapted to individual sites. For example, side 6 can be made longer, for example, on the order of 8 feet, so that the inlet 4 can be lengthened. The pumping rate will be selected to maintain the apparatus at the desired water level.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. An apparatus for attachment to a dock or floating platform for removing debris from a water surface of a marina or harbor, said water surface having a first water level, said apparatus comprising:

an openable body having a top, a bottom and at least one side wall and being formed of a material having substantially neutral buoyancy;

a plurality of inlets in said at least one side wall, each inlet of said plurality of inlets comprising an opening in said at least one side wall having at least one weir notch and sufficient dimensions to permit said debris to pass through said inlet;

collection means having a plurality of flow-through openings;

a pump for maintaining a substantially constant flow of water into said plurality of inlets and through said flow-through openings in said collection means; and attachment means for attaching said body to said dock or floating platform;

wherein said body floats in said marina or harbor at a predetermined level such that a second water level within said body is lower than said first water level.

2. An apparatus as in claim 1 wherein said collection means comprises a basket having dimensions to closely fit within said body.

3. An apparatus as in claim 2 wherein said basket includes means for lifting said basket from said body when said body is opened.

4. An apparatus as in claim 1 wherein said collection means comprises at least one perforated partition disposed within said body between said pump and said inlet.

5. An apparatus as in claim 1 wherein said inlets comprising a plurality of weir notches.

6. An apparatus as in claim 5 wherein said plurality of weir notches all have the same width and depth.

7. An apparatus as in claim 5 wherein each of said plurality of weir notches has a different width and depth from other weir notches.

8. An apparatus as in claim 5 wherein at least one of said plurality of weir notches is closeable.

9. An apparatus as in claim 1 wherein said body is rectangular and has four said side walls, at least two of said side walls having one said inlet formed therein.

10. An apparatus as in claim 9 wherein said side walls having said inlet are adjacent each other.

11. An apparatus as in claim 9 wherein said plurality of inlets are configured to generate a vortex within said body.

12. An apparatus as in claim 1 wherein said material is polypropylene.

13. A method for collecting debris floating on a water surface of a marina or harbor, said method which comprises:

selecting a pumping means for maintaining a substantially constant flow of water;

disposing said pumping means within an openable body;

placing said openable body within said marina or harbor, said openable body having at least one side wall with a plurality of inlet openings therethrough having at least one weir notch;

attaching said openable body to a dock or floating platform so that said plurality of inlets at a surface water level of said water surface;

pumping water out of said openable body at a pumping rate so that an interior water level within said body is lower than said surface water level whereby water containing said debris is drawn toward and into said openable body through said plurality of inlets; and collecting said debris with a collection means disposed within said openable body.

14. A method for collecting debris as in claim 13 wherein the step of pumping water comprises maintaining a flow rate within the approximate range of 14,000 to 25,000 gallons per minute.

15. A method for collecting debris as in claim 13 which further comprises emptying said openable body by lifting said collection means out of said openable body.

16. A method for collecting debris as in claim 13 which further comprises emptying said openable body by manually removing said debris collected within said openable body.

17. A method for collecting debris as in claim 13 wherein the step of pumping water comprises generating a vortex in water within said openable body.

18. A method as in claim 13 wherein said openable body has four said side walls with one inlet through each of two of said side walls.

19. A method as in claim 18 wherein said two side walls having inlets are adjacent each other.

20. An apparatus for removing floating debris from a surface of water in a marina or harbor, said water surface having a first water level, the apparatus comprising:

an openable body having a top, a bottom and two adjacent side walls;

at least two inlets formed in said two adjacent side walls, said inlets having at least one weir each inlet of said at least two inlets having a lower edge and an upper edge and sufficient dimensions to permit said floating debris to pass through said inlet, said at least two inlets being configured to create a vortex within said body when water is drawn through said at least two inlets;

collection means disposed within said body and having a plurality of perforations to through which water may flow;

a pump means for maintaining a substantially constant flow of water into said at least two inlets and through said plurality of perforations in said collection means, said pump causing a second water level within said body to be lower than said first water level; and attachment means for attaching said body to said dock or floating platform;

wherein said body floats in said marina or harbor at a predetermined level such that said first water level is between said lower edge and said upper edge of said each inlet so that said floating debris may be drawn into said body through said each inlet.

* * * * *